United States Patent [19]

Takezaki

[11] Patent Number: 4,745,863

[45] Date of Patent: May 24, 1988

[54] METHOD FOR PRINTING A TUBULAR FABRIC

[76] Inventor: Akira Takezaki, 41-11, Oaza-Ogaito, Kumatori-cho, Sennan-gun, Osaka, Japan

[21] Appl. No.: 8,844

[22] Filed: Jan. 30, 1987

[30] Foreign Application Priority Data

Feb. 6, 1986 [JP] Japan ..... 61-25230
Jan. 23, 1987 [JP] Japan ..... 62-14794

[51] Int. Cl.[4] ..... B41F 17/00

[52] U.S. Cl. ..... 101/426; 101/35; 101/129; 101/407 R

[58] Field of Search ..... 101/35, 114, 126, 129, 101/407 R, 407 A, 407 BP, 426; 26/85, 80; 38/64, 139, 138, 136, 135; 108/51.3; 297/442; 229/109

[56] References Cited

U.S. PATENT DOCUMENTS

| | | | |
|---|---|---|---|
| 1,793,101 | 2/1931 | Labombarde | 229/109 X |
| 2,019,156 | 10/1935 | Mueller, et al. | 101/114 X |
| 3,026,015 | 3/1962 | Severn | 108/51.3 X |
| 3,992,988 | 11/1976 | Dwyer | 101/407 R X |

FOREIGN PATENT DOCUMENTS

| | | | |
|---|---|---|---|
| 2308508 | 11/1976 | France | 101/35 |
| 157361 | 12/1981 | Japan | 101/114 |

*Primary Examiner*—Clifford D. Crowder

*Attorney, Agent, or Firm*—Ciotti & Murashige, Irell & Manella

[57] ABSTRACT

An underplate for use in the printing of a tubular fabric, which is made in the shape of a polygonal tube that can be transformed in shape along the lines of the angles; and a method for printing a tubular fabric conprising: (1) inserting the underplate into the tubular fabric; (2) making the fabric flat along appropriate lines of angles in said polygonal tube; (3) doing printing on or near the center of the front surface of the fabric, corresponding to the front surface of said flat shape; (4) turning over the fabric with said flat shape; doing printing in the same way on or near the center of the back surface of the fabric, corresponding to the back surface of said flat shape; (5) bringing back said flat shape to its original shape; (6) making the fabric flat again along different lines of angles in said polygonal tube, in such a manner that a different flat shape is formed from the polygonal tube, with the above-mentioned two regions of the fabric that have been printed at the sides of this second flat shape; (7) doing printing in the same manner on or near the center of the front surface of the fabric, corresponding to the front surface of said second flat shape; (8) turning over the fabric with said second flat shape; and (9) doing printing in the same manner on or near the center of the back surface of the fabric, corresponding to the back surface of said second flat shape, whereby a continuous printed design can be printed around the circumference of the tubular fabric.

4 Claims, 9 Drawing Sheets

METHOD FOR PRINTING A TUBULAR FABRIC

BACKGROUND OF THE INVENTION

1. Field of the Invention

This invention relates to an underplate for use in the printing of tubular fabrics and a method for printing tubular fabrics with the use of said underplate. More particularly, it relates to an underplate for the formation of a continuous pattern in the direction of the circumference of tubular fabrics and to a method for the printing of tubular fabrics with the use of the underplate.

2. Description of the Prior Art

Conventional underplates for use in the printing of tubular fabrics are made, as shown in FIG. 10(*a*), of a single plate 100 of aluminum with a thickness of about 1 mm. When a tubular fabric 200 is printed by the use of this plate 100, first, the plate 100 is introduced into the fabric 200, and printing is successively carried out on the front surface 201 and the reverse surface 202 on the fabric 200 that is in close contact with the front surface and the reverse surface of this plate 100. The finished printed fabric 200 has, as shown in FIG. 10(*b*), a streak-shaped region about 1 mm wide that is not printed, which corresponds to the two edges 110 of the plate 100, on the fabric surface 220. The creation of this unprinted region 220 is inevitable, no matter how thin the plate 100 is made.

Thus, it is not possible to form a continuous design by screen printing around tubular fabrics such as socks or panty hose without forming a longitudinal unprinted stripe.

SUMMARY OF THE INVENTION

The underplate of this invention, which overcomes the above-discussed and numerous other disadvantages and deficiencies of the prior art, is made in the shape of a polygonal tube that can be transformed in shape along the lines of the angles.

The polygonal tube is, in a preferred embodiment, covered with an elastic sheet.

The polygonal tube is, in a preferred embodiment, made in the shape of a tube with four surfaces.

The polygonal tube is, in a more preferred embodiment, made in the shape of a tube with eight surfaces.

The method for printing a tubular fabric of this invention, which overcomes the above-discussed and numerous other disadvantages and deficiencies of the prior art, comprises: (1) inserting, into the tubular fabric, an underplate made in the shape of a polygonal tube that can be transformed in shape along the lines of the angles; (2) making the fabric flat along appropriate lines of angles in said polygonal tube; (3) doing printing on or near the center of the front surface of the fabric, corresponding to the front surface of said flat shape; (4) turning over the fabric with said flat shape; doing printing in the same way on or near the center of the back surface of the fabric, corresponding to the back surface of said flat shape; (5) bringing back said flat shape to its original shape; (6) making the fabric flat again along different lines of angles in said polygonal tube, in such a manner that a different flat shape is formed from the polygonal tube, with the above-mentioned two regions of the fabric that have been printed at the sides of this second flat shape; (7) doing printing in the same manner on or near the center of the front surface of the fabric, corresponding to the front surface of said second flat shape; (8) turning over the fabric with said second flat shape; and (9) doing printing in the same manner on or near the center of the back surface of the fabric, corresponding to the back surface of said second flat shape, whereby a continuous printed design can be printed around the circumference of the tubular fabric.

The polygonal tube is, in a preferred embodiment, covered with an elastic sheet.

The polygonal tube is, in a preferred embodiment, made in the shape of a tube with four surfaces.

The polygonal tube is, in a more preferred emmbodiment, made in the shape of a tube with eight surfaces.

Thus, the invention described herein makes possible the objects of (1) providing an underplate for the printing of tubular fabrics by which a printed continuous design can be printed around a tubular fabric; and (2) providing a method for printing tubular fabrics with the use of said underplate.

BRIEF DESCRIPTION OF THE DRAWINGS

This invention may be better understood and its numerous objects and advantages will become apparent to those skilled in the art by reference to the accompanying drawings as follows:

FIG. 10(*b*) is a perspective view showing a tubular fabric printed with the use of the underplate shown in FIG. 10(*a*).

DESCRIPTION OF THE PREFERRED EMBODIMENTS

The underplate of this invention is a tube polygonal in form made of materials such as aluminum, steel, or other metals, or of plastic, wood, etc. The tube is made so that every angle can be folded, and adjacent flat surfaces are connected with adhesive tape. When this tube is made into a flat shape by being folded along some of the angles, the surface that is formed on the flat shape is completely level. The tube can be made as a polygon with, for example, four surfaces, six surfaces, eight surfaces, etc. It is preferable that the tube be covered with a sheet made of an elastic material such as rubber, so that the surface of the flat body made from the tube is smooth.

EXAMPLE 1

Figure 2:
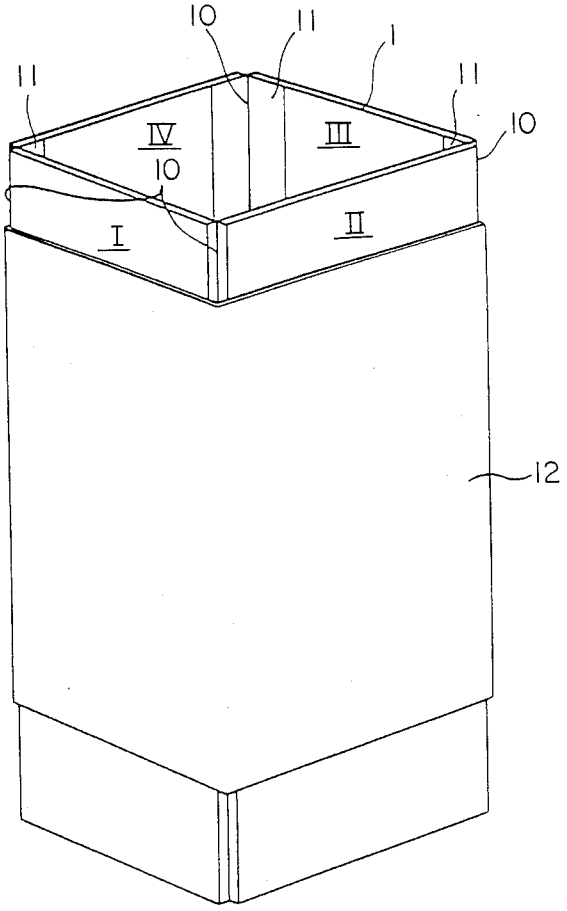
FIG. 2 is a perspective view showing an underplate of this invention.

The underplate of this invention is made, as shown in FIG. 2, in the shape of a tube with four surfaces. The tube 1 is composed of surfaces I, II, III, and IV, which are made of aluminum plates, connected together by a connector 11 such as adhesive tape. Each of the angles 10 of this tube can be folded; there is an elastic cover 12 made from a material such as rubber that covers the tube 1, which has no bad effects on the formation of a printed design along the joints of surfaces.

Figure 1:
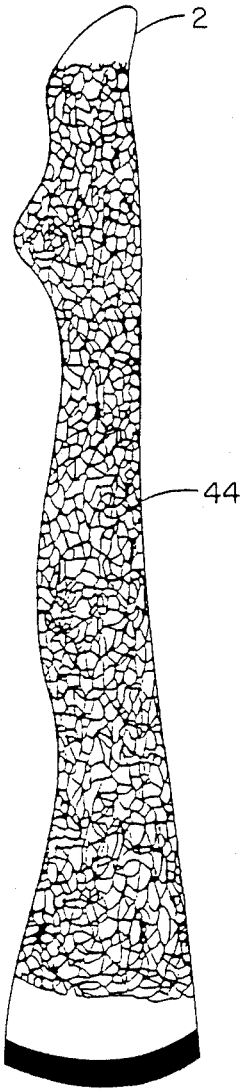
FIG. 1 is a perspective view showing a tubular fabric printed with a desired design in a continuous manner around the fabric.
Figure 3:
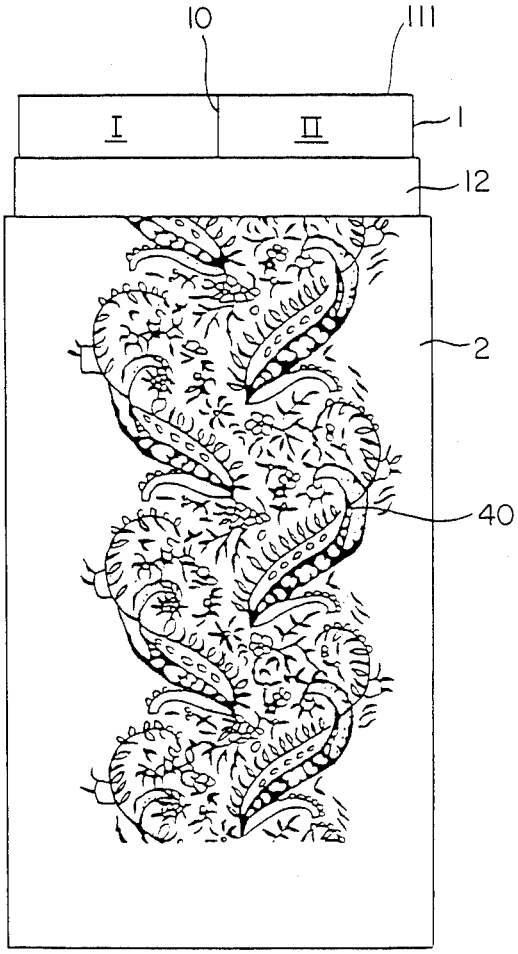
FIGS. 3 to 5 are schematic diagrams showing a printing method of this invention that uses the underplate shown in FIG. 2.
Figure 4:
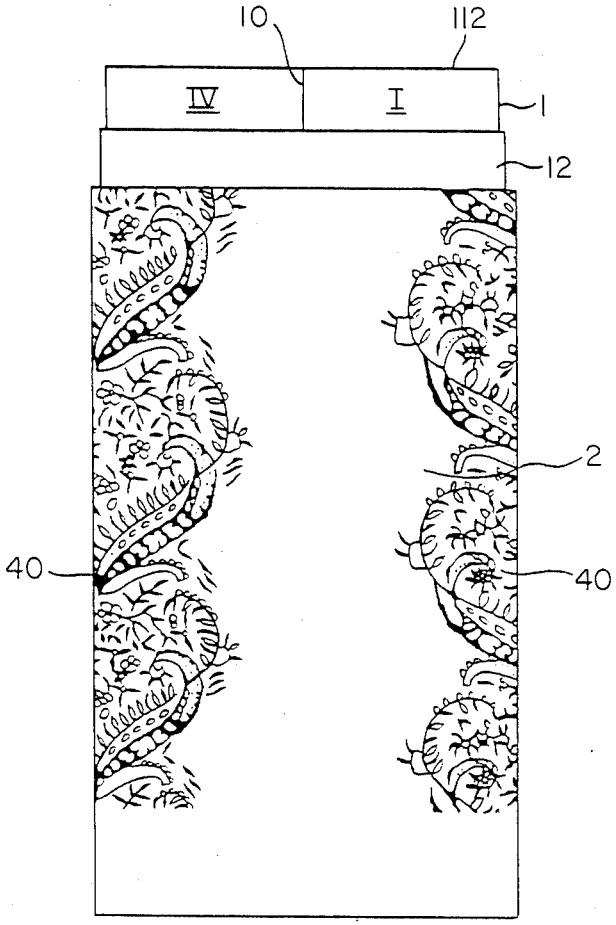
Figure 5:
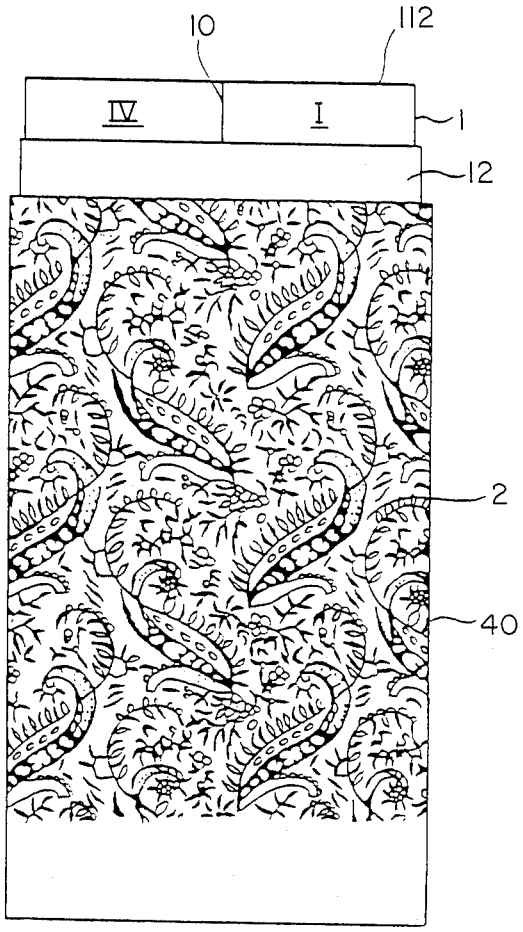

FIGS. 3 to 5 show the method for screen printing of tubular fabrics by the use of the four-surfaced tube 1 mentioned above. First, the tube 1 is inserted into the tubular fabric 2 to be printed, which is a stocking, etc. If because there is an elastic cover 12, the tube 1 cannot be smoothly inserted into the fabric 2, a guide (not shown) is placed against either the tube 1 or the fabric 2, and the tube 1 is then introduced into the fabric 2. The tube 1 is folded along the angle 10 between surfaces I and IV and along the angle 10 between surfaces II and III to make a flat shape (FIG. 3). The flat shape 111 now has a surface (made of surfaces I and II) on which screen printing is done by a well-known method in or near the center of the surface of the fabric 2, forming the desired pattern 40 (FIG. 3). Next, this flat shape 111 and the fabric 2 are turned over together, and on the other surface of flat shape 111 (the surface formed from surface III and surface IV), printing is done in the same way in or near the center of the surface of the fabric 2. Next, the flat shape 111 is brought back to its starting shape. Then, a different flat shape 112 is formed by the folding of the tubes 1 along the angle 10 between surfaces I and II and along the angle 10 between surfaces III and IV (FIG. 4). Along the two edges of this flat shape 112 and in that vicinity, there is the above-mentioned design 40 printed on both the upper and lower surfaces. On one surface of this flat shape 112 (the surface formed by surface I and surface IV), the corresponding parts of the fabric 2, on or near the center, are screen-printed in the same way so as to be continuous with the design 40 already printed along the edges of this surface (FIG. 5). Next, the flat shape 112 and the fabric 2 are turned over together, and on the other surface of the flat shape 112 (the surface formed from surface II and surface III), printing is done in the same way in or near the center of the surface of fabric 2, so as to be continuous with the design 40 already printed along the edges, resulting in the tubular fabric 2 printed with the continuous design 44 around the tubular fabric, as shown in FIG. 1.

EXAMPLE 2

Figure 6:
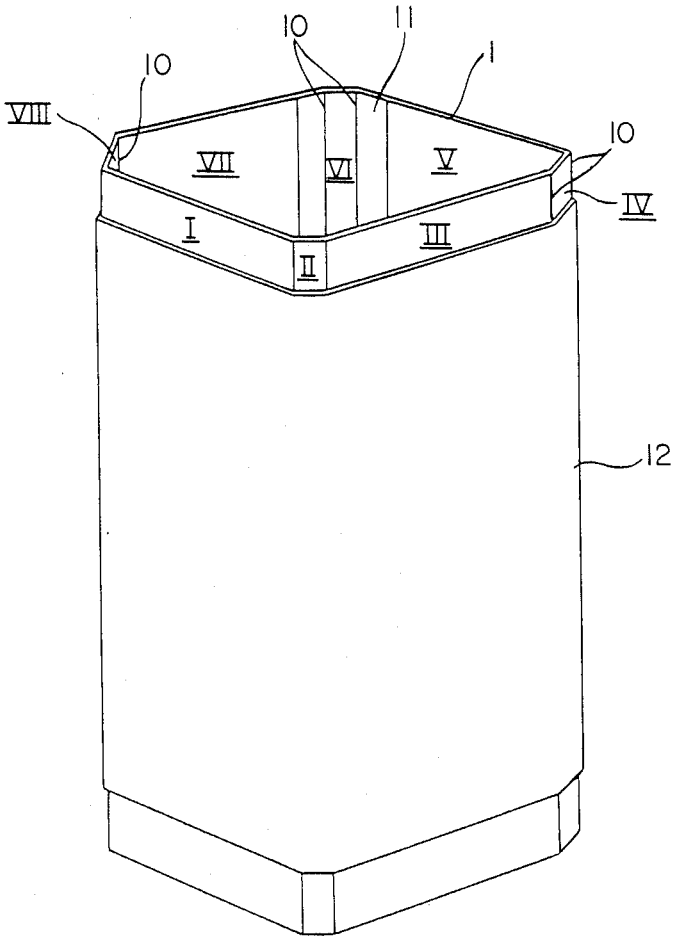
FIG. 6 is a perspective view showing another underplate of this invention.

A different example is given in FIG. 6 of an underplate of this invention. This underplate, tube 1, is made in the shape of an octagon. The octagonal tube 1 has more angles than does the four-surfaced tube of the above example, so it is easy to obtain a smooth surface, and it is easy to print a delicate pattern with its use. This tube 1 is made from eight aluminum plates that are connected with adhesive tape 11. It is covered with an elastic cover 12 made of rubber, etc., so that the outer surface will be smooth.

Figure 7:
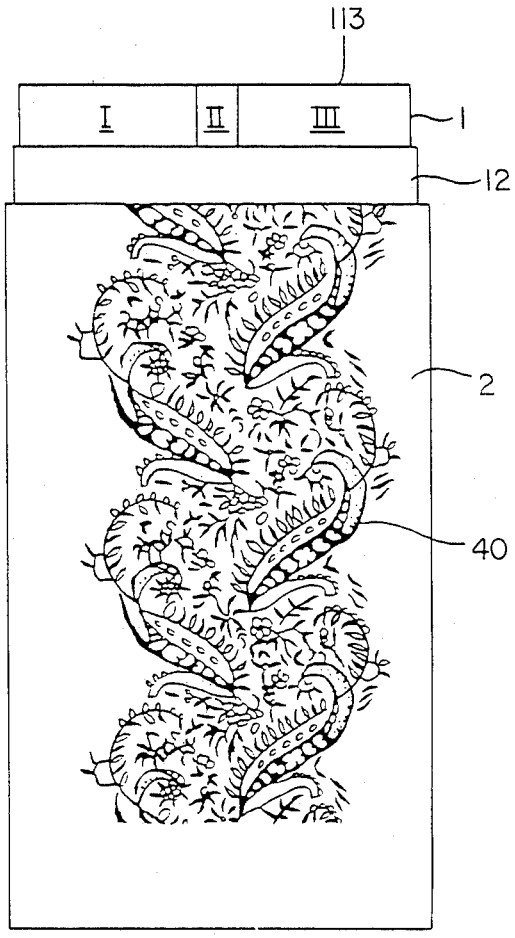
FIGS. 7 to 9 are schematic diamgrams showing another printing method of this invention that uses the underplate shown in FIG. 6.
Figure 8:
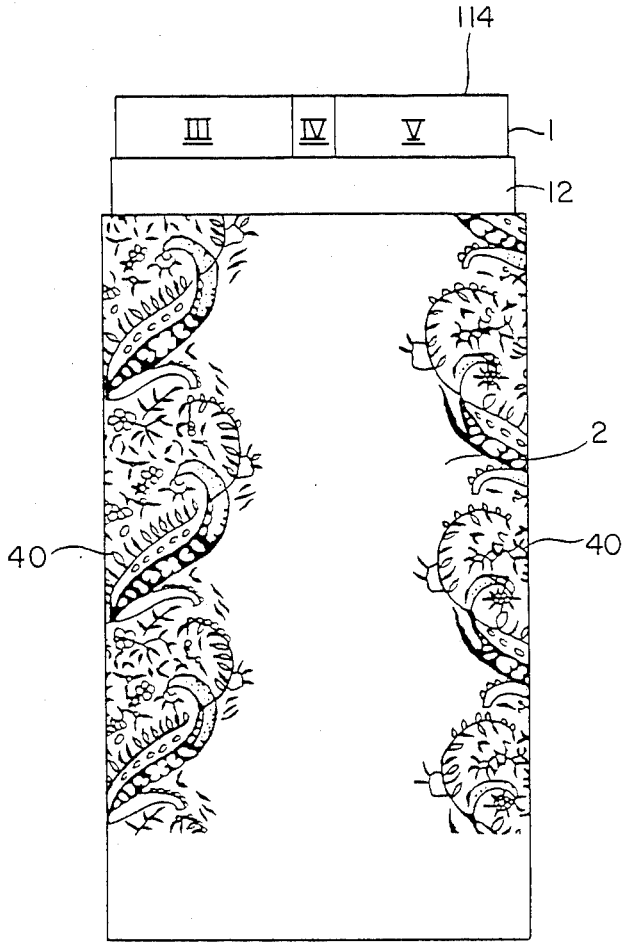
Figure 9:
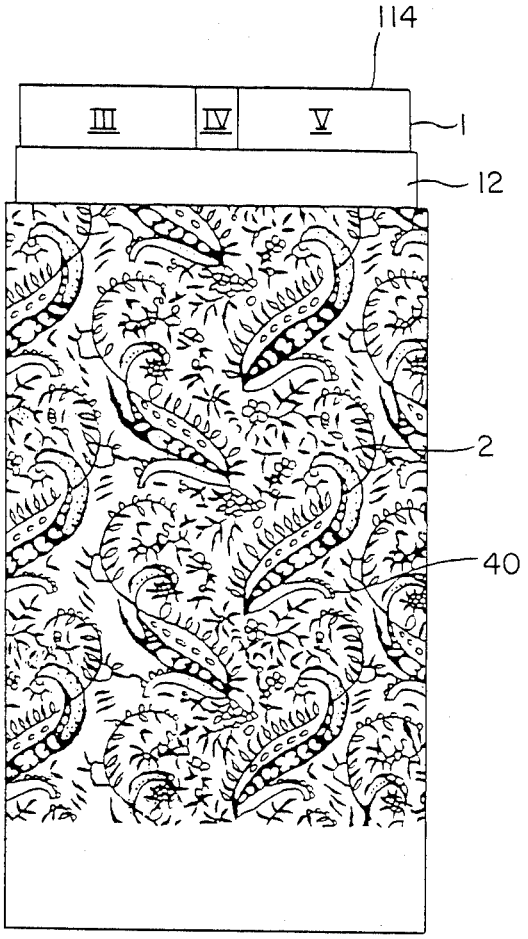
Figure 10A:
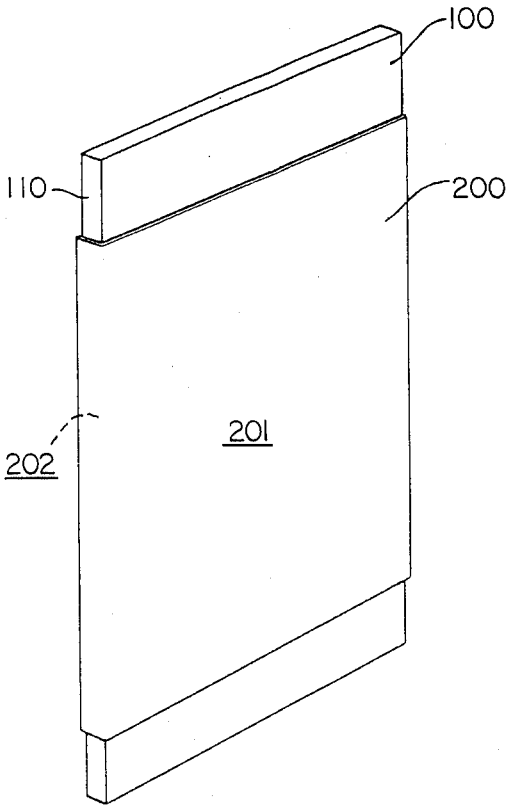
FIG. 10a PRIOR ART
FIG. 10(*a*) is a perspective view showing a conventional underplate introduced into a tubular fabric.
Figure 10B:
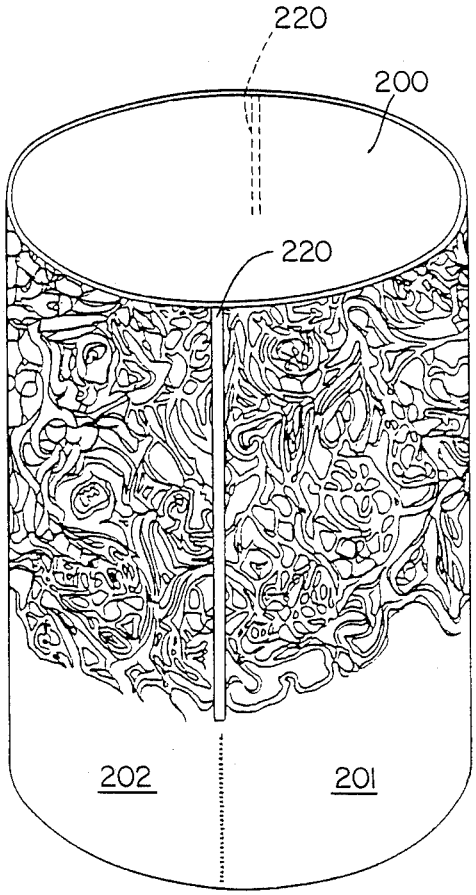
FIG. 10b PRIOR ART

With the use of this tube 1, tubular fabrics such as stockings can be printed with the desired pattern as follows: First, the tube 1 is introduced in to the tubular fabric 2 such as a stocking. The tube 1 is made into a flat shape 113 by being folded along the angles 10 between surfaces I and VIII, surfaces III and IV, surfaces IV and V, and surfaces VII and VIII (FIG. 7). On one of the surfaces of this flat shape 113 (the surface formed with surface I, surface II, and surface III), the corresponding parts of the fabric 2, in or near the center, are printed with the desired design 40 by a well-known screen-printing method. Next, the flat shape 113 and the fabric 2 are turned over together, and on the other surface of flat shape 113 (the surface formed from surface V, surface VI, and surface VII), printing is done in the same way in or near the center of the surface of fabric 2. Next, the flat shape 113 is brought back to its starting shape. Then, a different flat shape 114 is formed by the folding of the tube 1 along the angles 10 between surfaces I and II, between II and III, between V and VI, and between VI and VII (FIG. 8). At the edges of this flat shape 114 and in that vicinity, on both the upper and lower surfaces,the above-mentioned design 40 has been printed (FIG. 8). On one surface of this flat shape 114 (the surface formed from surface III, surface IV, and surface V), printing is done in the same way in or near the center of the surface of fabric 2 so that the design is continuous with the design 40 already printed on the edges, as mentioned before (FIG. 9).

Next, the flat shape 114 and the fabric 2 are turned over together, and on the other surface (the surface formed from surface VII, surface VIII, and surface I), printing is done in the same way in or near the center of the surface of fabric 2, so as to be continuous with the design 40 already printed along the edges. In this way, the fabric 2 is printed with the design 44 in a continuous manner around the fabric, as shown in FIG. 1. Because the tube 1 of this example is in the shape of an octagon, the above-mentioned flat shapes 113 and 114 have on their insides a hollow corresponding in width to that of the surface IV (or VIII) and the surface II (or VI). During printing, a plate with the same thickness as the width of the surface IV and II can be placed as needed in this hollow.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A method for printing a tubular fabric comprising:
(1) inserting, into the tubular fabric, an underplate made in the shape of a polygonal tube that can be transformed in shape along the lines of the angles;
(2) making the fabric flat along appropriate lines of angles in said polygonal tube;
(3) doing printing on or near the center of the front surface of the fabric, corresponding to the front surface of said flat shape;
(4) turning over the fabric with said flat shape; doing printing in the same way on or near the center of the back surface of the fabric, corresponding to the back surface of said flat shape;
(5) bringing back said flat shape to its original shape;
(6) making the fabric flat again along different lines of angles in said polygonal tube, in such a manner that a different flat shape is formed from the polygonal tube, with the above-mentioned two regions of the fabric that have been printed at the sides of this second flat shape;
(7) doing printing in the same manner on or near the center of the front surface of the fabric, corresponding to the front surface of said second flat shape;
(8) turning over the fabric with said second flat shape; and (9) doing printing in the same manner on or near the center of the back surface of the fabric, corresponding to the back surface of said second flat shape, whereby a continuous printed design can be printed around the circumference of the tubular fabric.

2. A method according to claim 1, wherein said polygonal tube is covered with an elastic sheet.

3. A method according to claim 1, wherein said polygonal tube is made in the shape of a tube with four surfaces.

4. A method according to claim 1, wherein said polygonal tube is made in the shape of a tube with eight surfaces.

* * * * *